US008253335B2

(12) United States Patent
Boroczki et al.

(10) Patent No.: US 8,253,335 B2
(45) Date of Patent: Aug. 28, 2012

(54) ARC SHAPED DISCHARGE CHAMBER FOR HIGH INTENSITY DISCHARGE AUTOMOTIVE LAMP

(75) Inventors: Agoston Boroczki, Budapest (HU); Istvan Csanyi, Dunakeszi (HU); Csaba Horvath, Budapest (HU); Tamas Panyik, Budapest (HU)

(73) Assignee: General Electric Company, Schenectady, NY (US)

( * ) Notice: Subject to any disclaimer, the term of this patent is extended or adjusted under 35 U.S.C. 154(b) by 107 days.

(21) Appl. No.: 12/793,441

(22) Filed: Jun. 3, 2010

(65) Prior Publication Data

US 2011/0298367 A1 Dec. 8, 2011

(51) Int. Cl.
*H01J 61/82* (2006.01)
*H01J 61/33* (2006.01)
*H01J 61/30* (2006.01)

(52) U.S. Cl. ..... 313/634; 313/620; 313/621; 313/631

(58) Field of Classification Search ..... 313/634, 313/623, 25

See application file for complete search history.

(56) References Cited

U.S. PATENT DOCUMENTS

| | | | | |
|---|---|---|---|---|
| 3,858,078 | A | 12/1974 | Koury | |
| 3,966,288 | A * | 6/1976 | Finch et al. | 445/22 |
| 4,001,623 | A * | 1/1977 | Howles et al. | 313/634 |
| 4,056,751 | A | 11/1977 | Gungle et al. | |
| 4,281,267 | A * | 7/1981 | Johnson | 313/25 |
| 4,498,027 | A | 2/1985 | Karlotski | |
| 4,687,453 | A * | 8/1987 | Lekebusch et al. | 445/4 |
| 4,891,554 | A | 1/1990 | Levand, Jr. | |
| 4,916,351 | A * | 4/1990 | Keeffe et al. | 313/25 |
| 6,815,889 | B2 | 11/2004 | Haacke et al. | |
| 7,348,731 | B2 | 3/2008 | Haacke et al. | |
| 2005/0116608 | A1 | 6/2005 | Haacke et al. | |
| 2006/0255742 | A1 | 11/2006 | Haacke et al. | |

FOREIGN PATENT DOCUMENTS

| | | | |
|---|---|---|---|
| EP | 0451997 | A2 | 10/1991 |
| EP | 1 174 904 | A1 | 1/2002 |
| EP | 1189259 | A2 | 3/2002 |
| FR | 2345808 | A1 | 10/1977 |

OTHER PUBLICATIONS

PCT Search Report issued in connection with corresponding WO Patent Application No. US11/36293 filed on May 12, 2011.

* cited by examiner

*Primary Examiner* — Sikha Roy
(74) *Attorney, Agent, or Firm* — Fay Sharpe LLP

(57) ABSTRACT

A method of forming a discharge lamp and the resultant discharge lamp include providing an arc tube having first and second ends offset from a central arcuate or curvilinear portion of the discharge chamber formed between the arc tube ends. Electrodes extend from the first and second ends and at least partially into the discharge chamber which is locally substantially rotationally symmetric, i.e., substantially circular cross-section over a length thereof. Preferably, the arc tube and discharge chamber have a curvilinear conformation where the first and second ends are located below the central portion of the arc tube and associated discharge chamber in horizontal orientation during operation. Terminal ends of the electrodes preferably follow a local axis of the curvilinear conformation. The wall thickness of the discharge chamber may be alternatively constant or non-constant along a longitudinal extent thereof.

26 Claims, 1 Drawing Sheet

ARC SHAPED DISCHARGE CHAMBER FOR HIGH INTENSITY DISCHARGE AUTOMOTIVE LAMP

BACKGROUND OF THE DISCLOSURE

Reference is made to commonly owned, co-pending U.S. patent applications Ser. No. 12/793,398, filed Jun. 3, 2010, Ser. No. 12/793,470, filed Jun. 3, 2010 and Ser. No. 12/793,494, filed Jun. 3, 2010.

High intensity metal halide discharge lamps produce light by ionizing a fill contained in a discharge chamber of an arc tube where the fill is typically a mixture of metal halides and buffer agent such as mercury in an inert gas such as neon, argon, krypton or xenon or a mixture of thereof. An arc is initiated in the discharge chamber between inner terminal ends of electrodes that extend in most cases at the opposite ends into the discharge chamber and energize the fill. In current compact high intensity metal halide discharge lamps, the molten metal halide salt pool of overdosed quantity often resides in a central bottom location of the generally ellipsoidal or tubular discharge chamber, which discharge chamber is disposed in a horizontal orientation during operation. This is the coldest part of the discharge chamber during lamp operation and consequently is often referred to as a "cold spot" location. The overdosed molten metal halide salt pool that is in thermal equilibrium with its saturated vapor developed above the dose pool within the discharge chamber and is situated at the cold spot forms a thin film layer on a significant portion of an inner wall surface of the discharge chamber. This molten metal halide salt pool blocks or filters out significant amounts of emitted light from the arc discharge. The dose pool thereby distorts the spatial intensity distribution of the lamp by increasing light absorption and light scattering in directions where the dose pool sits in the discharge chamber. Moreover, the dose pool alters the color hue of light that passes through the thin liquid film of the dose pool.

Designers of luminaires and optical projection systems, and particularly of automotive headlamps associated with these types of lamps must consider these issues when designing the beam fowling optics. For example, distorted light rays are either blocked by non-transparent metal or plastic shields, or the light rays may be distributed in directions that are not critical for the application. These distorted light rays passing through the dose film are thus generally ignored and because of this the distorted light rays represent losses in the optical system since the distorted light rays do not take part in forming the main beam of the headlamps.

In an automotive headlamp application these scattered and distorted light rays are used for slightly illuminating the road immediately preceding the automotive vehicle, or the distorted rays are directed to road signs well above the road. Because of these beam collection losses, efficiency of the optical systems of automotive headlamps equipped with compact high intensity discharge lamps is typically no higher than about 40% to 50%.

As compact discharge lamps become smaller in wattage, and also adopt reduced geometrical dimensions, a solution is required with the light source in order to avoid such light collection losses in the optical system. This would result in achieving higher illumination levels along with lower energy consumption of the headlighting system.

Thus, a need exists to address the strong shading effect associated with the dose pool, and the impact on performance and efficiency of the headlamp optics designed around the lamp as a result of the uneven light intensity distribution from the lamp.

SUMMARY OF THE DISCLOSURE

A discharge lamp includes an arc tube having an arc-shaped discharge chamber formed along a similarly arc-shaped portion of the arc tube. First and second electrodes have inner terminal ends extending at least partially into the discharge chamber from opposite ends. In horizontal orientation during operation, since the discharge arc is bowing in an upward direction due to buoyancy forces acting upon the discharge plasma with temperature gradient across its volume, the arc tube with the arc-shaped discharge chamber is oriented in such way that its shape follows the upward bowing shape of the discharge arc, and thus the first and second ends of the discharge chamber are located at a different height than a central portion of the discharge chamber while the fill material will collect at a cold spot, that is at the coldest portion(s) of the inner wall surface thereof.

A wall thickness is substantially uniform along a length of the arc tube in one embodiment, and may have a non-constant wall thickness in another embodiment.

Inner terminal end portions of the first and second electrodes preferably extend in a direction substantially conforming to the curvilinear shape of the discharge chamber ends.

A central portion of the discharge chamber is equal or slightly wider in cross-section than cross section at the first and second end portions of the discharge chamber, but preferably no greater than 150%, more preferably no greater than 130%, in diameter.

In one exemplary embodiment, a bottom wall apex point of the central portion of the discharge chamber is located above the first and second ends of the discharge chamber in horizontal orientation during operation.

The local cross-section of the discharge chamber is basically rotationally symmetric, preferably of substantially circular cross-section, over a length thereof, and is not coaxial with the first and second ends of the arc tube.

Portions of the first and second electrodes that extend into the discharge chamber extend in substantially parallel relation to the curvilinear conformation of the discharge chamber.

A method of forming a discharge lamp, more preferably a high intensity metal halide discharge lamp, includes providing an arc tube having a curvilinear discharge chamber with a substantially constant wall thickness in some of the embodiments and with varying wall thickness in other embodiments, that is axially disposed between coaxial first and second seal ends and contains an ionizable fill. First and second electrodes are located in the first and second seal ends, respectively, with at least portions extending into the discharge chamber.

A primary benefit of the present disclosure is a controlled location of a metal halide salt pool in a compact high intensity discharge chamber.

A tangential benefit is that the dose pool is offset from the center portion of the discharge chamber and has less impact on the light intensity and on the spatial light intensity distribution emitted by the lamp, thereby resulting in the lamp being more efficient and provides a more even light intensity distribution.

A related benefit is that the automotive headlamp optical designers can develop a more efficient headlamp system.

Still another benefit of providing a precise location for the liquid dose pool in the light source is the ability to effectively address scattered and discolored light rays that typically result from light transmitted through the dose pool located at the cold spot of the discharge chamber.

Still other features and benefits of the present disclosure will become more apparent from reading and understanding the following detailed description.

DETAILED DESCRIPTION OF THE PREFERRED EMBODIMENTS

Figure 1:
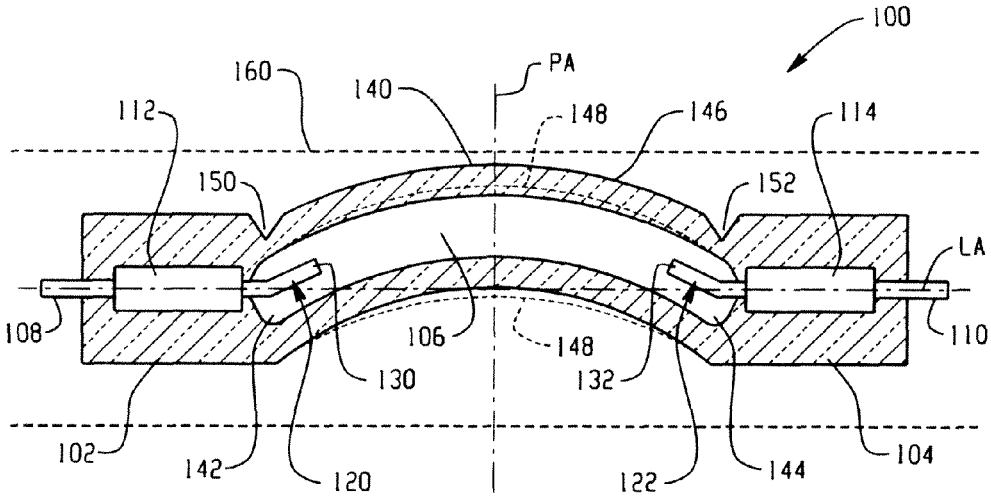
FIG. 1 is a longitudinal cross-sectional view through a preferred embodiment of an arc tube with the arc-shaped discharge chamber.
Figure 2:
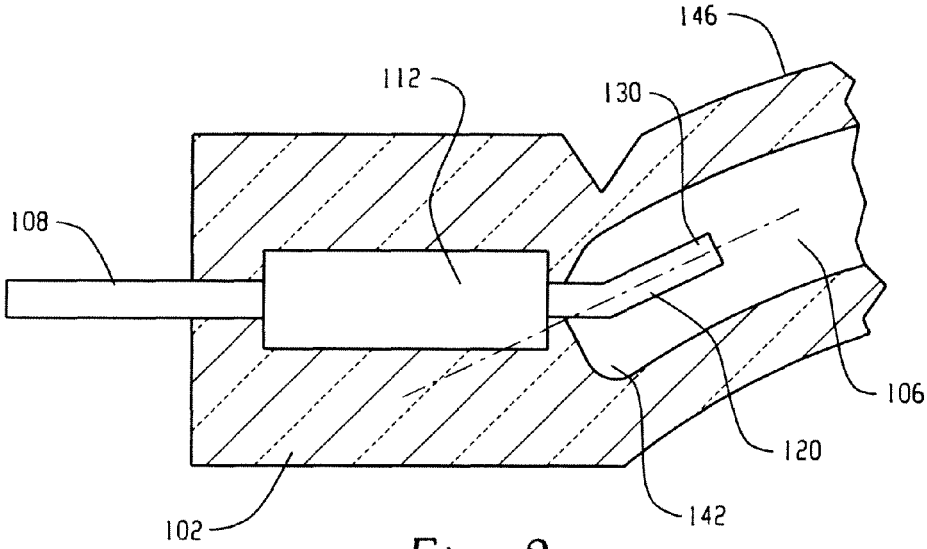
FIG. 2 is an enlarged view of one end of the arc tube of the type shown in FIG. 1.

Turning first to FIG. 1, an arc tube 100 includes a first pinch seal end 102 and a second pinch seal end 104 that are substantially parallel and in this particular instance are co-axially aligned along a longitudinal axis LA. Disposed between the seal ends is a curvilinear, arc-shaped, or arcuate discharge chamber 106 that is locally rotationally symmetric and preferably has a substantially constant cross-sectional conformation along its length between the seal ends 102, 104. Particularly, in the illustrated exemplary embodiment, the discharge chamber has a substantially circular cross-section along its length. A first outer lead 108 and second outer lead 110 are partially received in the respective seal ends 102, 104 and adapted for connection with a power source (not shown). If the lamp is made according to quartz or hard glass high intensity discharge lamp technology, each outer lead 108, 110 is mechanically and electrically connected, for example, to a foil member 112, 114, respectively, which in the preferred arrangement is a molybdenum foil received in the pinch seal arrangement of the respective seal end. First and second electrodes 120, 122 extend inwardly toward the discharge chamber from the molybdenum foils 112, 114 in substantially linear fashion, i.e., as shown here aligned along the longitudinal axis and aligned with one another, and are either straight or may be bent or curved at their inner terminal end portions to generally follow a beginning portion (sometimes referred to herein as the "local axis") of the arcuate or curvilinear path of the discharge chamber and the central portion of the arc tube (see FIG. 2). Thus, in the exemplary embodiment depicted by FIG. 1 and FIG. 2, inner terminal ends of the electrodes 130, 132 are disposed at an angle relative to the remainder outer terminal end portions of the electrodes 120, 122 which in this exemplary embodiment are aligned with the longitudinal axis of the seal ends. Furthermore, it is evident to one skilled in the art that the plane of the pinch seal sections at the end portions of the arc tube need not necessarily lie in the plane of the curvature of the center portion of the arc tube as illustrated by FIG. 1. Alternatively, these planes can be perpendicular, as another extreme arrangement of the embodiment. It is also to be noted that in the case where a ceramic arc tube material is used, construction of these seal portions is completely different, which fact does not have any serious impact on the basic concept of having an arcuate-shaped center portion in the arc tube.

In the embodiment of FIG. 1, the electrode that partially extends into the discharge chamber includes a first linear outer portion that is generally parallel or coaxial with the longitudinal axis LA, and then the electrode angles or bends into a second inner portion for a limited distance that follows the local axis of the tubular portion of the end of the discharge chamber. Alternatively, a substantially long electrode of straight linear or unbent geometry may extend all along the distance from its base point in the pinch seal or end region of an end wall of the discharge chamber to its inner terminal end point along a path that is parallel to the local axis of the tubular end of the discharge chamber. In yet another alternative exemplary embodiment a substantially short electrode of straight linear or unbent geometry may extend all over its length along a path that is parallel or coaxial with the longitudinal axis LA thus deviating from the local axis of the tubular end of the discharge chamber but keeping a required distance between its inner terminal end and the curved bottom discharge chamber wall so that the wall is not overheated by the hot electrode.

An ionizable fill material is sealed in the discharge chamber and reaches a discharge state in response to an arc initiated or formed between the inner terminal ends of the electrodes in response to a voltage applied to the first and second outer leads. The fill of high intensity metal halide discharge lamps normally includes noble gas component, such as neon, argon, krypton, xenon or a mixture thereof at a well-defined pressure for starting the lamp, metal halides for generating the required luminous flux and spectral power distribution (color) of visible light, and may or may not include mercury as a buffer agent as there is a desire to reduce the amount of mercury in the fill, or to remove mercury entirely therefrom. Typically, an excess amount of metal halide dosing material is provided in the discharge chamber. During operation of the lamp therefore, a liquid phase of the dose of metal halide salts is situated at a cold spot of the discharge chamber as described in the Background.

As evident in FIG. 1, the curvilinear shape of the central portion 140 of the arc tube provides for an arrangement where the first and second ends of the discharge chamber, i.e., where the electrodes extend into the discharge chamber, are located at a different height than the central portion of the discharge chamber in horizontal orientation during operation. Particularly, in FIG. 1, each of the first and second ends 142, 144 are located below the remainder of the discharge chamber which arcs upwardly toward an apex point or peak located approximately mid-way between the electrodes. In other words, the arc tube and likewise the discharge chamber are preferably symmetrical about an axis PA that extends perpendicular through a midpoint of the longitudinal axis LA, although this symmetry may not always necessarily be required.

Moreover, the discharge chamber has a generally substantially constant cross-sectional conformation along the length from the first end 142 to the second end 144. In this particular arrangement, the discharge chamber has a rotationally symmetric local cross-section which is substantially a circular cross-sectional conformation along its length in the exemplary embodiment. Further, the outer circumference of the arc tube is also generally constant from the first end to the second end such that wall 146 has a substantially constant thickness over the longitudinal extent of the discharge chamber. However, and as represented by dashed lines 148 in FIG. 1, the wall thickness may be non-constant over the length of the discharge chamber since this allows modification of the temperature distribution of the discharge chamber. For example, if the temperature of an upper portion of the wall 146 of the arc tube becomes too high for the arc tube material to withstand it over the required lifetime of the lamp as a result of the arc being close to the wall surface, the chamber wall can be cooled by increasing the thickness of the wall as represented by reference numeral 148 along select portions or the entire length of the wall and thereby conduct more heat away toward end portions of the discharge chamber. Likewise, the thickness of a central portion of the bottom portion of the wall may also be non-constant as represented by reference numeral 148 in FIG. 1 to conduct more heat from the top to the bottom of this central portion. The liquid dose resides at the bottom of the chamber under horizontal operating conditions, and thus increased heat flow likewise increases the vapor pressure of the dose materials, and consequently the efficacy of the lamp. In the very extreme case, by proper discharge chamber wall geometry, cross section and thermal distribution the liquid dose can be fully evaporated from the central bottom portion of the discharge chamber.

Orienting the inner terminal ends 130, 132 of the electrodes to turn upwardly from the remainder outer portion of the electrodes, and generally follow the conformation of the arcuate discharge chamber, facilitates formation of defined cold spots along those portions of the discharge chamber adjacent the interface of the electrodes with the seal ends and along end regions 142, 144. As such, the cold spots are located away from a central portion of the discharge chamber and the liquid dose pool situated at the location of the cold spot does not interfere with emitted light from the discharge. In another exemplary embodiment, similar cold spot conditions may be achieved with straight electrodes of preferably short insertion length into the discharge chamber that are coaxially oriented with the longitudinal axis PA. In such preferred cases when a cold spot is positioned at the end regions 142, 144 of the arc chamber, absorption and scattering of the light rays emitted by the arc discharge is considerably reduced, which eliminates issues with discoloring of the light rays passing though the liquid dose film conventionally located at the cold spot in the center bottom portion of the arc chamber, and also aids the optical designers in more consistently handling and directing the light rays in a desired manner. Less light is wasted from the arc discharge leading to less energy required for a given total usefully emitted luminous flux from a lamp.

It will also be recognized in FIG. 1 that optional recesses 150, 152 may be provided at the interface of the curvilinear portion of the discharge chamber with the sealed end, at least particularly along the upper portion thereof. This optional recess(es), which can also be described as a non-constant wall thickness of the arc tube along its length, reduces heat losses, although one skilled in the art will appreciate that lamp operation can also be effectively handled without such recesses.

The degree of curvature or arc in the arc tube may also be limited. For example, and as evident in FIG. 1, an outer wall surface portion of the non-coaxial portion of the arc tube substantially aligns with the coaxial axis between the first and second ends in the preferred embodiment. Generally, however, a maximum extent of lateral displacement due to the curvature is such that the external surface of the central portion along the lower region of the arc tube does not extend to the upper side of the longitudinal axis LA. That is, the apex point of central upper portion of the non-coaxial or curvilinear portion is located above the first and second ends, while the apex point of the central bottom portion of the wall 146 approaches the longitudinal axis LA of the lamp but generally does not exceed the vertical position of this longitudinal axis LA. Although the degree of the curvature as illustrated may be varied, it provides a general guideline for the extent of curvature, and also is associated with the maximum lateral displacement in a direction perpendicular to the longitudinal axis LA as a result of being received in a protective outer envelope, generally represented by dotted line 160.

Each arrangement achieves a better light performance and higher luminous efficacy by directing the liquid dose to a location in the discharge chamber of the lamp that will not impact the light output from the lamp. All of this is achieved without increasing lamp power or the maximum thermal load imposed on the lamp. Further, it is not necessary to enlarge the outer dimensions of the protective outer envelope of the lamp. By locating the dose pool at the opposite ends, light intensity through the central region of the arc tube is no longer impacted by the shading effect of the dose pool, nor is the color of the light emitted from the arc discharge lamp adversely impacted. Further, the optics for directing the light, such as headlamp optics associated with an automotive discharge lamp application, are more easily handled since a spatially more uniform light intensity distribution is provided from the discharge region. The arc or curvilinear-shaped arc tube preferably has a substantially constant wall thickness throughout the length of the discharge chamber, i.e., the outer dimension of the discharge chamber follows the inner shape and those regions around the base of the electrodes where they enter into the discharge chamber. These end regions act as collector reservoirs or collectors for the liquid dose which are not in the vapor phase during operation. The preferably bent electrodes direct the arc away from these reservoirs and ensure that the position of the cold spot is where desired. As a result of this unique geometry of the arc tube, it is possible to increase and relocate the temperature of the cold spot in the discharge chamber. This again has the advantage that the same light intensity is preferably emitted in a rotationally symmetric manner since the dose pool is relocated to a position outside of the discharge area. The position of the dose pool has less effect on the light distribution thereby making the lamp more efficient, and more even spatial light intensity distribution results, resulting in unhampered light emission from the central region of the discharge chamber. More light is generated which means higher attainable luminous efficacy from the lamp and pet its optical designers to develop a more efficient optical system, or specifically in case of automotive applications a headlamp system of higher light collection efficiency.

When used in an automotive headlamp environment, the arcuate or curvilinear arc discharge will typically operate between about 25 watts and 60 watts, and is operated in a horizontal orientation. In a fully integrated lamp, the driving electronics is attached to the arc tube to form a single complex lamp assembly. Thus, in certain instances, the rated lamp power may or may not take into consideration the power consumption associated with the built-in driving electronics, or may refer to a stand-alone lamp. There is also an increased desire to use an ionizable fill in the discharge chamber that has a reduced amount of mercury, or is even mercury free, when mercury is fully replaced by other less hazardous substance acting as buffer agent in the fill. Thus, the use of the arcuate arc tube is fully applicable to such arrangements, including uses other than automotive applications.

The disclosure has been described with reference to the preferred embodiments. Obviously, modifications and alterations will occur to others upon reading and understanding the preceding detailed description. For example, the first seal end and the second seal end may not be substantially parallel or co-axially aligned along a longitudinal axis in alternative embodiments. It is intended that the disclosure be construed as including all such modifications and alterations.

What is claimed is:

1. An automotive discharge lamp assembly comprising:

an arc tube having first and second ends in substantially coaxial relation and a discharge chamber formed therebetween;

first and second electrodes received in the first and second ends, respectively, and at least partially extending into the discharge chamber, at least a portion of the first and second electrodes are substantially parallel to a longitudinal axis and at least a portion of the first and second electrodes extend along an arcuate path between the first and second ends of the discharge chamber; and wherein the discharge chamber is substantially of circular cross section over a length thereof and is not coaxial with the first and second ends.

2. The lamp assembly of claim 1 wherein the arc tube has a curvilinear conformation between the first and second ends, and the discharge chamber has a conforming curvilinear conformation.

3. The lamp assembly of claim 2 wherein a wall of the discharge chamber has a substantially constant thickness therealong.

4. The lamp assembly of claim 2 wherein a wall of the discharge chamber has non-constant thickness therealong.

5. The lamp assembly of claim 1 wherein the discharge chamber has a substantially constant wall thickness therealong.

6. The lamp assembly of claim 1 wherein the discharge chamber has non-constant wall thickness therealong.

7. The lamp assembly of claim 1 wherein the arc tube is operated in a substantially horizontal orientation, and the first and second ends are located at least partially below an apex point of the non-coaxial portion.

8. The lamp assembly of claim 7 wherein an outer wall surface portion of the non-coaxial portion of the arc tube aligns with the longitudinal axis between the first and second ends.

9. The lamp assembly of claim 1 wherein an outer wall surface portion of the non-coaxial portion of the arc tube aligns with the longitudinal axis between the first and second ends.

10. The lamp assembly of claim 1 wherein the lamp or its arc tube is rated for operation at 25 W maximum.

11. The lamp assembly of claim 1 wherein the lamp or its arc tube is rated for operation at 60 W maximum.

12. The lamp assembly of claim 1 wherein a lamp fill is substantially mercury free.

13. The lamp assembly of claim 1 wherein a lamp fill is mercury free.

14. The lamp assembly of claim 1 wherein a lamp fill contains mercury.

15. An automotive discharge lamp assembly comprising:

an arc tube having seal portions at first and second ends that are substantially aligned along a first axis and enclosing a discharge chamber disposed between the ends that contains an ionizable fill therein, the discharge chamber having a curvilinear conformation and substantially constant wall thickness along a length thereof that deviates from the first axis; and first and second electrodes having portions extending substantially parallel to a longitudinal axis and portions extending at least partially into the discharge chamber from the seal portions at the first and second ends in substantial alignment to a path of the curvilinear conformation of the discharge chamber, respectively, for energizing the fill to a discharge state in response to an associated voltage applied thereto.

16. The lamp assembly of claim 15 operative in a horizontal position and wherein an apex point of a central portion of the arc tube and associated discharge chamber is located higher than the first and second ends.

17. The lamp assembly of claim 15 wherein the discharge chamber has a substantially circular cross-section over a length thereof.

18. The lamp assembly of claim 15 wherein the discharge chamber has a substantially constant wall thickness therealong.

19. The lamp assembly of claim 15 wherein the discharge chamber has a non-constant wall thickness therealong.

20. The lamp assembly of claim 15 wherein the lamp or its arc tube is rated for operation at 25 W maximum.

21. The lamp assembly of claim 15 wherein the lamp or its arc tube is rated for operation at 60 W maximum.

22. The lamp assembly of claim 15 wherein a lamp fill is substantially mercury free.

23. The lamp assembly of claim 15 wherein the lamp fill is mercury free.

24. The lamp assembly of claim 15 wherein the lamp fill contains mercury.

25. A method of forming an automotive discharge lamp comprising:

providing an arc tube having a curvilinear discharge chamber that contains an ionizable fill and with a substantially constant wall thickness axially disposed between coaxial first and second seal ends;

locating first and second electrodes in substantially parallel relation with a longitudinal axis within the first and second seal ends, respectively, with at least portions thereof extending into the discharge chamber; and orienting an inner terminal end of each electrode at an angle relative to the longitudinal axis.

26. The method of claim 25 further comprising orienting the arc tube in a horizontal operating position with an apex point of a central portion of the arc tube and associated discharge chamber above the first and second seal ends.

* * * * *